US009520681B2

(12) United States Patent
Peng et al.

(10) Patent No.: US 9,520,681 B2
(45) Date of Patent: Dec. 13, 2016

(54) PLUG CONNECTOR, RECEPTACLE CONNECTOR, AND ELECTRIC CONNECTOR ASSEMBLY THEREOF

(71) Applicant: Shenzhen Deren Electronic Co., Ltd, Shenzhen (CN)

(72) Inventors: Junlan Peng, Shenzhen (CN); Zhengyi Chen, Shenzhen (CN); ZhuDong Huo, Shenzhen (CN)

(73) Assignee: Shenzhen Deren Electronic Co., Ltd, Shenzhen (CN)

( * ) Notice: Subject to any disclaimer, the term of this patent is extended or adjusted under 35 U.S.C. 154(b) by 0 days.

(21) Appl. No.: 14/922,712

(22) Filed: Oct. 26, 2015

(65) Prior Publication Data

US 2016/0043510 A1 Feb. 11, 2016

Related U.S. Application Data

(63) Continuation of application No. PCT/CN2015/082209, filed on Jun. 24, 2015.

(30) Foreign Application Priority Data

Jun. 27, 2014 (CN) ..... 2014 2 0353142 U
Dec. 30, 2014 (CN) ..... 2014 2 0856922 U

(51) Int. Cl.
*H01R 13/658* (2011.01)
*H01R 13/6581* (2011.01)
(Continued)

(52) U.S. Cl.
CPC ..... *H01R 13/6581* (2013.01); *H01R 13/6593* (2013.01); *H01R 13/665* (2013.01);
(Continued)

(58) Field of Classification Search
CPC . H01R 13/658; H01R 13/6658; H01R 23/688; H01R 13/514; H01R 9/032
(Continued)

(56) References Cited

U.S. PATENT DOCUMENTS 5,797,771 A * 8/1998 Garside ..... H01R 13/6275 439/358
5,848,914 A * 12/1998 Lang ..... H01R 13/6592 439/607.47
(Continued)

*Primary Examiner* — Gary Paumen
(74) *Attorney, Agent, or Firm* — Ladas & Parry LLP

(57) ABSTRACT

Disclosed are a plug connector component, a receptacle connector component, and a connector assembly. The plug connector comprises: an inserting portion; a printed circuit board, one portion of which is coupled to the inserting portion; an upper housing; and a lower housing, on which the upper housing is jointed, a receiving space for receiving the printed circuit board being formed between the upper housing and the lower housing, a side wall of the lower housing being partially outwardly bent to form a receiving groove on the side wall of the lower housing, a side of the printed circuit board being received in the receiving groove, the inserting portion being secured at a front end of the upper housing and the lower housing. The receptacle connector comprises a second metal shell having a joint chamber and a first module and a second module that are secured in the second metal shell, wherein: a first terminal is inlaid and insert molding in the first module; a second terminal is inlaid and insert molding in the second module, a contact portion of the first terminal overlapping a contact portion of the second terminal in a height direction perpendicular to an insertion direction; and a shielding plate is further inlaid and insert molding in the second module.

20 Claims, 8 Drawing Sheets

(51) Int. Cl.

| | |
|---|---|
| ***H01R 13/66*** | (2006.01) |
| ***H01R 13/6593*** | (2011.01) |
| *H01R 12/72* | (2011.01) |
| *H01R 13/6594* | (2011.01) |
| *H01R 24/60* | (2011.01) |
| *H01R 107/00* | (2006.01) |

(52) U.S. Cl.
CPC ..... *H01R 12/724* (2013.01); *H01R 13/6594* (2013.01); *H01R 13/6658* (2013.01); *H01R 24/60* (2013.01); *H01R 2107/00* (2013.01)

(58) Field of Classification Search
USPC ..... 439/607.46–607.48, 76.1, 607.05
See application file for complete search history.

(56) References Cited

U.S. PATENT DOCUMENTS 6,582,252 B1 * 6/2003 Lin ..... H01R 12/725 439/160
6,875,031 B1 * 4/2005 Korsunsky ..... H01R 23/6873 439/607.05
7,651,342 B1 * 1/2010 Wu ..... H01R 9/032 439/607.46
7,654,831 B1 * 2/2010 Wu ..... H01R 12/62 439/607.46
7,811,128 B2 * 10/2010 Pan ..... H01R 23/688 439/607.03
8,007,317 B2 * 8/2011 Su ..... H01R 13/502 439/607.46
8,075,341 B2 * 12/2011 Su ..... H01R 13/5845 439/607.48
8,724,343 B2 * 5/2014 Feldstein ..... H05K 9/0058 361/616
8,834,197 B2 * 9/2014 Wu ..... H01R 23/005 439/497
8,992,252 B2 * 3/2015 McClellan ..... H01R 13/6587 439/108
9,022,800 B2 * 5/2015 Yang ..... H01R 13/6581 439/487
2001/0012730 A1 * 8/2001 Ramey ..... H01R 12/585 439/607.05
2008/0280491 A1 * 11/2008 Chen ..... H01R 13/65802 439/607.05

* cited by examiner

PLUG CONNECTOR, RECEPTACLE CONNECTOR, AND ELECTRIC CONNECTOR ASSEMBLY THEREOF

This application is a continuation of International Application No. PCT/CN2015/082209, filed Jun. 24, 2015, which claims priority to Chinese Patent Application No. 201420353142.1 filed Jun. 27, 2014, and 201420856922.8 filed Dec. 30, 2014, three of which are hereby incorporated by reference in their entireties.

TECHNICAL FIELD

The present invention relates to the field of connectors, and in particular, relates to a plug connector, a receptacle connector, and an electric connector assembly thereof.

BACKGROUND

Electric connectors are also referred to as circuit connectors, including plug connectors and receptacle connectors. The electric connector is a conductive device that bridges two conductors in a loop, such that currents or signals may flow from one conductor to another conductor. The electric connectors are widely applied in various electrical lines, achieving the function of connecting or disconnecting the currents or signals.

In the related art, a plug connector comprises a conductive terminal socket, a printed circuit board connected to the conductive terminal socket, and a housing. The conductive terminal socket is secured at a front end of the housing, and the printed circuit board is positioned inside the housing. Since the printed circuit board is not secured to the housing, during transportation of the connector, the printed circuit board may collide with the housing, and thus may damage the printed circuit board.

In addition, with the development of technologies, higher speed signal transmission is a development trend, and in this case, electrical connectors for transmitting signals at higher speed are widely applied. However, in the prior art, receptacle connectors are subject to unreasonable structures, which are unfavorable to manufacture and assembling. This affects the comprehensive performance of the electrical connectors.

SUMMARY

The present invention provides a plug connector, a receptacle connector, and an electrical connector assembly. According to the present invention, a printed circuit board is secured in a receiving space formed between an upper housing and a lower housing. In addition, by improvements to the structure of the receptacle connector, the connection reliability is improved, the stability in signal transmission is ensured, and the comprehensive performance of the electrical connector is enhanced.

An embodiment of the present invention provides a plug connector, comprising:

an inserting portion;

a printed circuit board, one portion of which is coupled to the inserting portion;

an upper housing; and a lower housing, on which the upper housing is jointed, a receiving space for receiving the printed circuit board being formed between the upper housing and the lower housing, a side wall of the lower housing being partially outwardly bent to form a receiving groove on the side wall of the lower housing, a side of the printed circuit board being received in the receiving groove, the inserting portion being secured at a front end of the upper housing and the lower housing.

Optionally, a side wall of the upper housing is inwardly bent to form a holding portion, the holding portion abutting against the upper surface of the printed circuit board.

Optionally, a side wall of the upper housing is provided with an opening, the opening mating with a partially outwardly bending portion of the side wall of the lower housing, such that a lower end of the opening on the side wall of the upper housing abuts against an upper end of the bending portion.

Optionally, the plug connector comprises a cable;

wherein the cable is welded on the other portion of the printed circuit board, and the cable is a circular cable or flexible flat cable.

Optionally, the inserting portion comprises an electrically conductive terminal seat, an insulating shell, and a first metal shell;

wherein the insulating shell is provided with a terminal slot, the electrically conductive terminal seat is secured in the terminal slot, the terminal slot opens upwards, the first metal shell wraps an outer surface of the insulating shell, and the electrically conductive terminal seat is coupled to the printed circuit board.

Optionally, the electrically conductive terminal seat comprises an electrically conductive terminal and plastic; and the electrically conductive terminal seat is integrally formed by means of embedment of the electrically conductive terminal and the plastic.

Optionally, the inserting portion further comprises a shielding sheet;

wherein the shielding sheet is secured on the outer surface of the insulating shell, and is arranged between the insulating shell and the first metal shell.

Optionally, the inserting portion further comprises an outer cap;

wherein the outer cap is secured on the first metal shell, and is adaptively coupled to the electrically conductive terminal.

Optionally, a bump is provided at a rear end of the first metal shell; and an abutting portion abutting against a front end of the bump is provided at a front end of the upper housing and/or the lower housing.

Optionally, the abutting portion comprises a first abutting portion and a second abutting portion;

wherein the first abutting portion is provided at a front end of a top plate of the upper housing and/or the lower housing, and abuts against the front end of the bump; and the second abutting portion extends from two sides of the first abutting portion, and abuts against a lateral side of the bump.

Optionally, a clip pad is provided at the rear end of the bump; and a clip hole is provided on the upper housing and/or lower housing, the clip pad being clipped and secured to the clip hole.

Optionally, the clip pad and the clip hole are fusion spliced together via laser welding.

An embodiment of the present invention provides a receptacle connector, comprising a second metal shell having a joint chamber and a first module and a second module that are secured in the second metal shell, wherein: a first terminal is inlaid and insert molded in the first module; a second terminal is inlaid and insert molded in the second module, a contact portion of the first terminal overlapping a contact portion of the second terminal in a height direction perpendicular to an insertion direction; and a shielding plate is further inlaid and insert molding in the second module.

Optionally, a protrusion portion exposing from a lateral end of a base and abutting against the second metal shell is provided on the shielding plate.

Optionally, a contact portion abutting against the protrusion portion is formed via stamping towards the joint chamber at a position on the second metal shell corresponding to the protrusion portion.

Optionally, a welding portion extending downwards is provided on a rear end of the shielding plate.

Optionally, the first module and the second module are assembled and secured in the second metal shell, and a positioning structure is provided between the first module and the second module.

Optionally, the first module is further provided with a first grounding pad, and the second module is further provided with a second grounding pad, the first grounding pad and the second grounding pad being secured to two sides of the first module and the second module via laser welding.

Optionally, an upper cap for limiting and securing the second metal shell is provided on the second metal shell.

An embodiment of the present invention provides an electrical connector assembly, comprising a plug connector as defined above and a receptacle connector as defined above.

The present invention achieves the following beneficial effects:

Different from the prior art, according to the present invention, a side wall of the lower housing is partially outwardly bent to form a receiving groove on the side wall of the lower housing, and when the printed circuit board is received in the receiving spaced firmed between the upper housing and the lower housing, a lateral side of the printed circuit board is received in the receiving groove, such that the printed circuit board may be secured in the receiving space. In addition, terminals are respectively inlaid and insert molding on the first module and the second module of the board connector, and a shielding plate is inlaid and insert molding on the second module. This improves the comprehensive performance of the connector while ensuring high speed transmission and reliability of the electrical connector.

DETAILED DESCRIPTION

Figure 1:
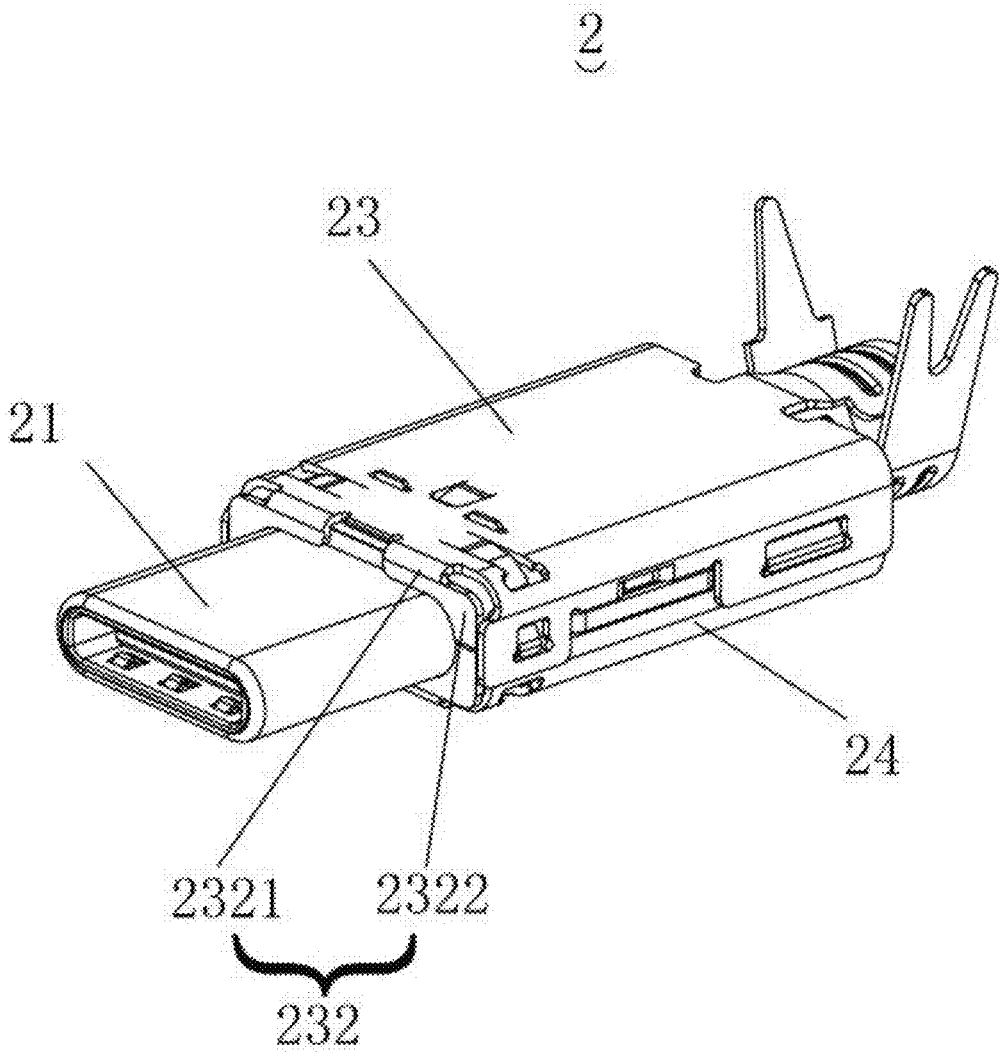
FIG. 1 is a schematic three-dimensional structural view of a plug connector according to an embodiment of the present invention.
Figure 2:
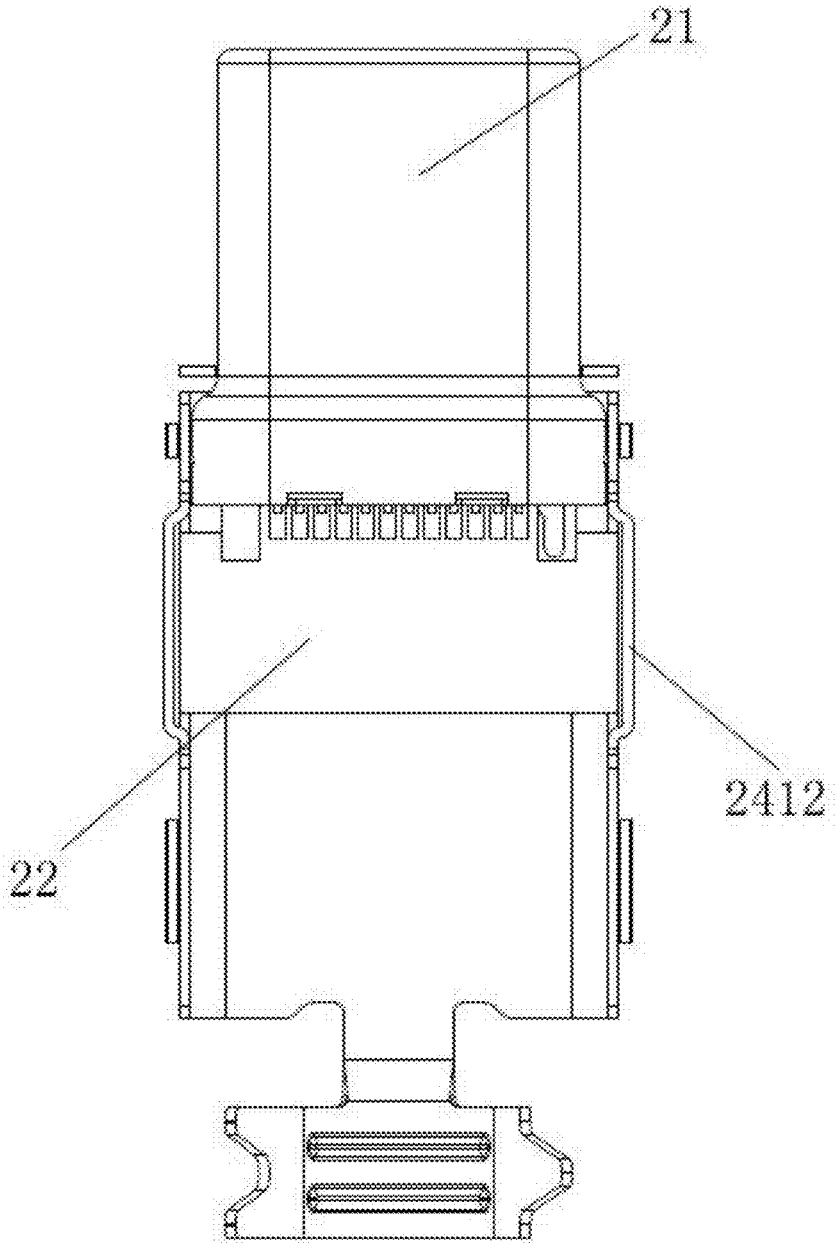
FIG. 2 is a top view of the plug connector according to an embodiment of the present invention.
Figure 3:
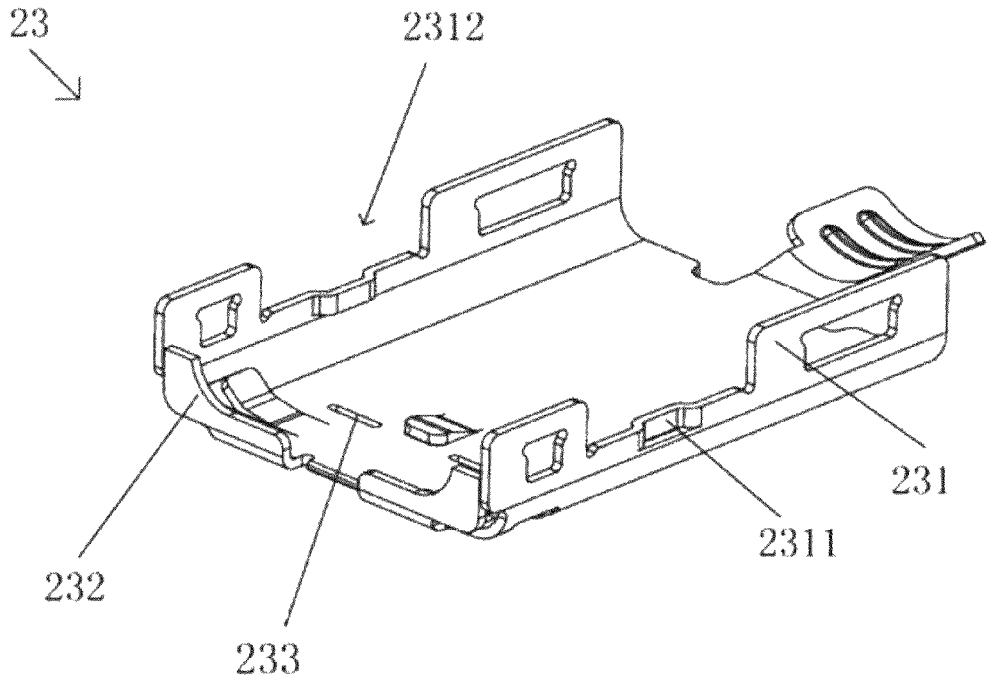
FIG. 3 is a schematic structural view of an upper housing of the plug connector according to an embodiment of the present invention.
Figure 4:
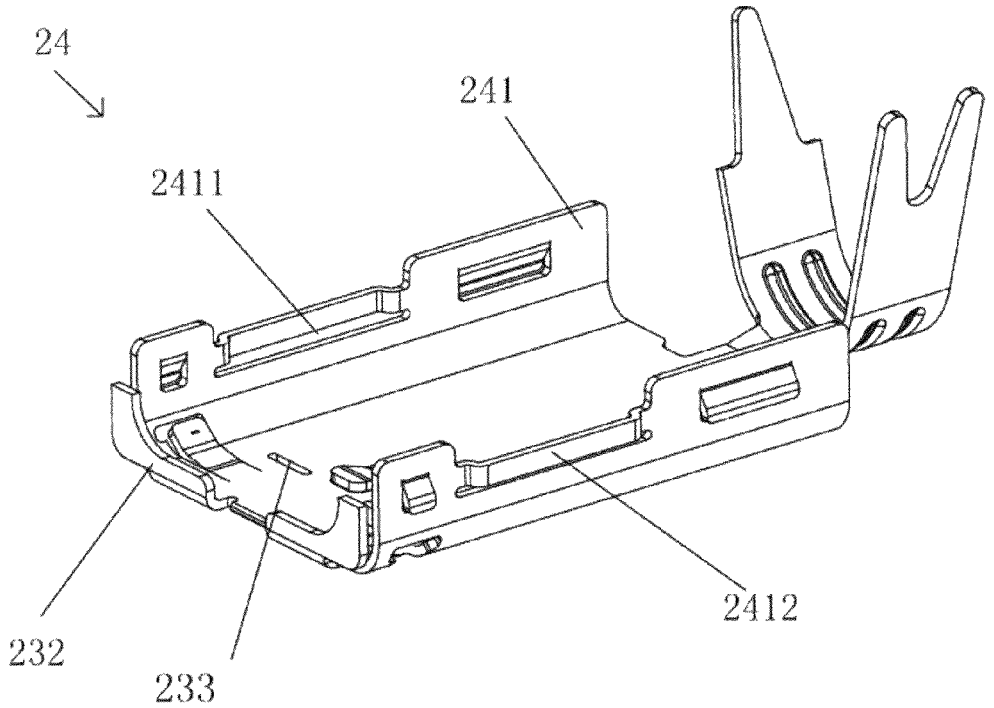
FIG. 4 is a schematic structural view of a lower housing of the plug connector according to an embodiment of the present invention.

For better understanding of the present invention, the present invention is described in detail with reference to attached drawings and specific embodiments. It should be noted that, when an element is defined as "being secured or fixed to" another element, the element may be directly positioned on the element or one or more centered elements may be present therebetween. When an element is defined as "being connected or coupled to" another element, the element may be directly connected or coupled to the element or one or more centered elements may be present therebetween. As used herein, the terms "vertical", "horizontal", "left", "right", and similar expressions are for illustration purposes.

Unless the context clearly requires otherwise, throughout the specification and the claims, technical and scientific terms used herein denote the meaning as commonly understood by a person skilled in the art. Additionally, the terms used in the specification of the present invention are merely for description the embodiments of the present invention, but are not intended to limit the present invention. As used herein, the term "and/or" in reference to a list of two or more items covers all of the following interpretations of the term: any of the items in the list, all of the items in the list and any combination of the items in the list.

As illustrated in FIG. 1 to FIG. 6, a plug connector 2 comprises: an inserting portion 21, a printed circuit board 22, an upper housing 23, and a lower housing 24.

The upper housing 23 is jointed on the lower housing 24, and a receiving space (not illustrated in the drawings) for receiving the printed circuit board 22 is formed between the upper housing 23 and the lower housing 24. The inserting portion 21 is secured to a front end of the upper housing 23 and the lower housing 24, and one portion of the printed circuit board 22 is coupled to the inserting portion 21. A side wall 241 of the lower housing 24 is partially outwardly bent to form a receiving groove 2411 on the side wall 241 of the lower housing 24, and a side of the printed circuit board 22 is received in the receiving groove 2411, such that the printed circuit board 22 is secured in the two side directions.

Further, a side wall 231 of the upper housing 23 is inwardly bent to form a holding portion 2311, and when the upper housing 23 is jointed on the lower housing 24, the holding portion 2311 abuts against the upper surface of the printed circuit board 22, such that the upper housing 23 and the lower housing 24 clamp and secure the printed circuit board 22 in up and down directions. In this way, the printed circuit board 22 is more stably and reliably secured.

A side wall 241 of the lower housing 24 is partially outwardly bent to form a bending portion 2412, and the side wall 231 of the upper housing 23 is provided with an opening 2312, wherein the opening 2312 mates with the outwardly bending portion 2412 of the side wall of the lower housing 24, such that a lower end of the opening 2912 on the side wall 231 of the upper housing 23 abuts against an upper end of the bending portion 2412. In this way, the assembled plug connector 2 is not subjected to depressions, and is more beautiful.

Figure 5:
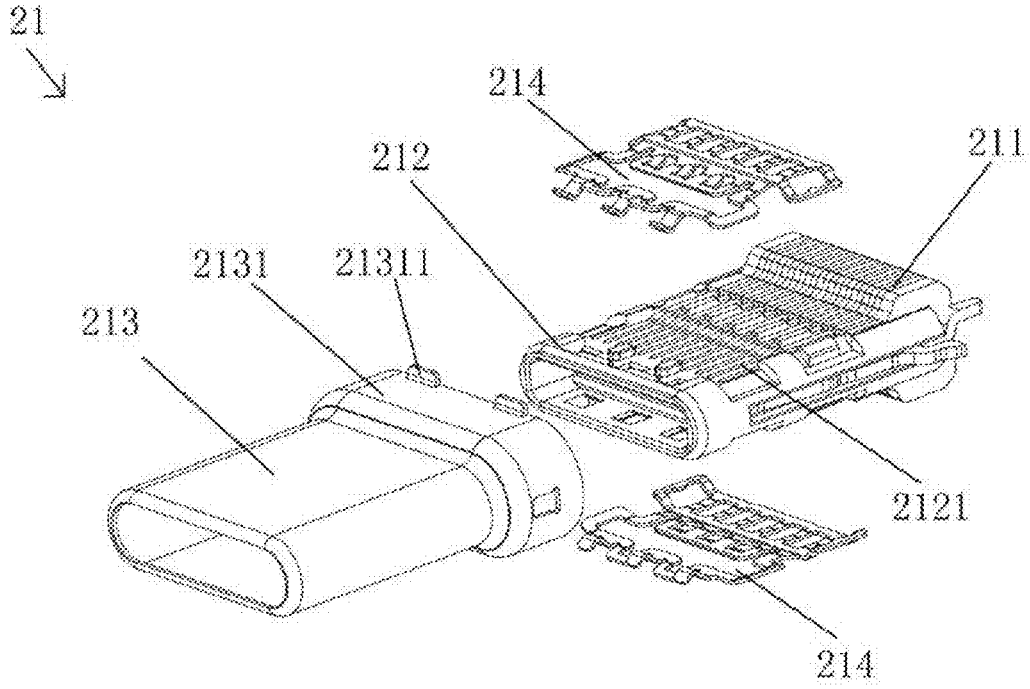
FIG. 5 is an explosive view 1 of an inserting portion of the plug connector according to an embodiment of the present invention.

With reference to FIG. 5, the inserting portion 21 comprises a an electrically conductive terminal seat 211, an insulating shell 212, and a first metal shell 213. The insulating shell 212 is provided with a terminal slot 2121, the electrically conductive terminal seat 211 is secured in the terminal slot, the terminal slot 2121 opens upwards, and the electrically conductive terminal seat 211 may be secured to the terminal groove 2121 by means of an adhesive, a buckle or the like the first metal shell 213 wraps an outer surface of the insulating shell 212, and the electrically conductive terminal seat 211 is coupled to the printed circuit board 22. The electrically conductive terminal seat 211 comprises an electrically conductive terminal (not illustrated in the drawings) and plastic (not illustrated in the drawings); and the electrically conductive terminal seat 211 is integrally formed by means of embedment of the electrically conductive terminal and the plastic.

Further, the inserting portion 21 further comprises a shielding sheet 214. The shielding sheet 214 is secured on the outer surface of the insulating shell 212, and is arranged between the insulating shell 212 and the first metal shell 213. Two shielding sheets 214 may be used, which are respectively disposed on an upper outer surface and a lower outer surface of the insulating shell 212. The shielding sheet 214 is configured to shield interference caused by the external environment to the electrical connector, and ensure transmission quality of the plug connector 2.

A bump 2131 is provided at a rear end of the first metal shell 213. An abutting portion 232 abutting against a front end of the bump 2131 is provided at a front end of the upper housing 23 and/or the lower housing 24, such that the rear end of the first metal shell 213 is clipped in the receiving space formed between the upper housing 23 and the lower housing 24, to prevent the inserting portion 21 from sliding forwards relative to the upper housing 23 and the lower housing 24 to detach from the upper housing 23 and the lower housing 24. The abutting portion 232 comprises a first abutting portion 2321 and a second abutting portion 2322. The first abutting portion 2321 is arranged at a front end of a top plate of the upper housing 23 and/or the lower housing 24, and abuts against the front end of the bump 2131. The second abutting portion 2322 extends from two sides of the first abutting portion 2321, and abuts against a lateral side of the bump 2131. A clip pad 21311 is provided at the rear end of the bump 2131; and a clip hole 233 is provided on the upper housing 23 and/or lower housing 24, the clip pad 21311 being clipped and secured to the clip hole 233, to prevent the inserting portion 21 from sliding backwards relative to the upper housing 23 or the lower housing 24 to detach from the upper housing 23 or the lower housing 24. In the embodiments of the present invention, the clip pad and the clip hole are fusion spliced together via laser welding. To be simple, the abutting portion 232 prevents the inserting portion 21 from sliding forwards relative to the upper housing 23 and the lower housing 24, the clip pad 21311 and the clip hole 233 prevent the inserting portion 21 from sliding backwards relative to the upper housing 23 and the lower housing 24, such that the inserting portion 232 is secured to the front end of the upper housing 23 and the lower housing 24. Nevertheless, in other alternative embodiments, the abutting portion 232 may also be secured to the front end of the upper housing 23 and the lower housing 23 by means of an adhesive, a bolt or the like.

Figure 6:
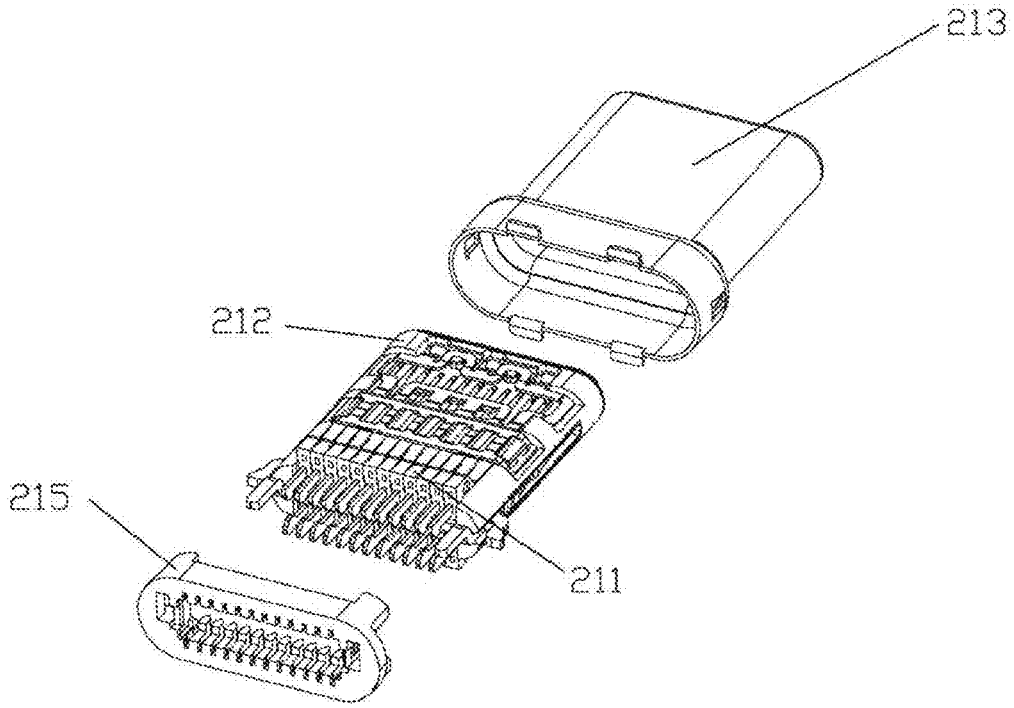
FIG. 6 is an explosive view 2 of the inserting portion of the plug connector according to an embodiment of the present invention.
Figure 7:
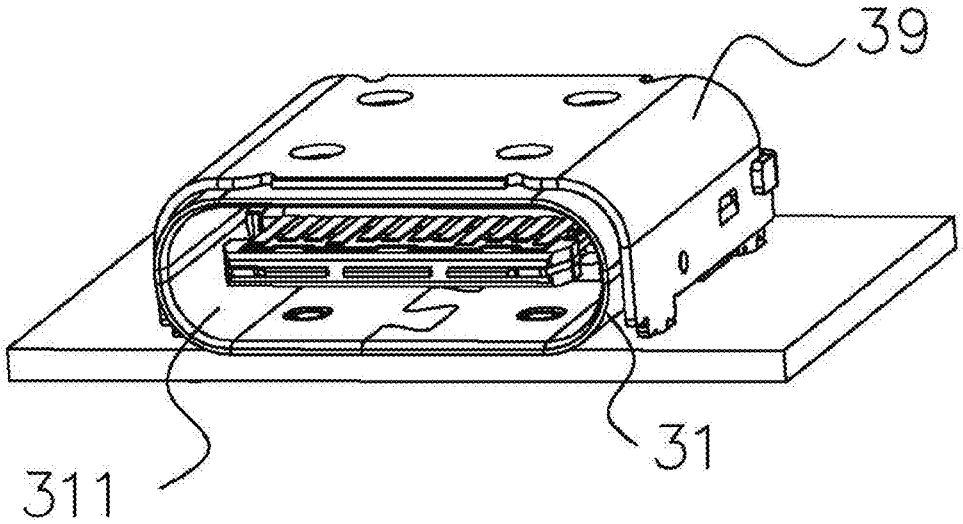
FIG. 7 is a schematic structural view of a receptacle connector according to an embodiment of the present invention.
Figure 8:
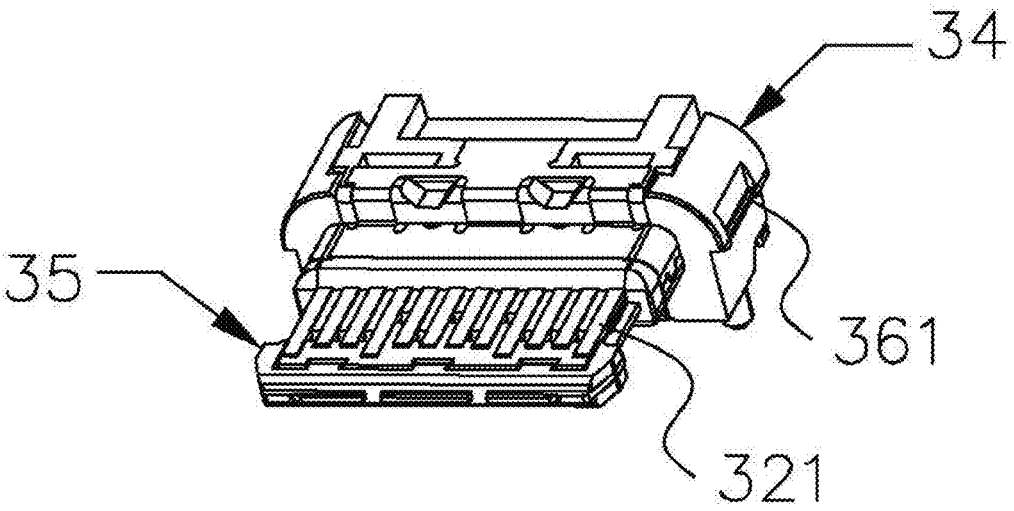
FIG. 8 is a schematic structural view of mating of a first module and a second module of the receptacle connector according to an embodiment of the present invention.
Figure 9:
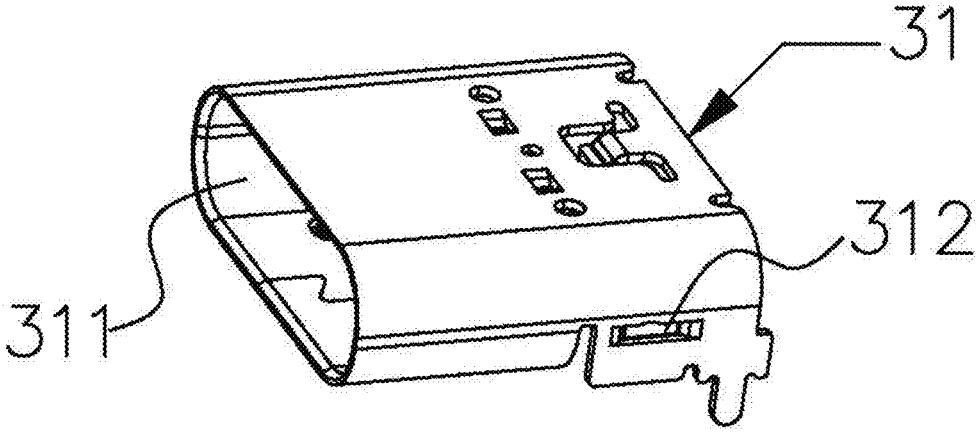
FIG. 9 is a schematic structural view of a second metal shell of the receptacle connector according to an embodiment of the present invention.
Figure 10:
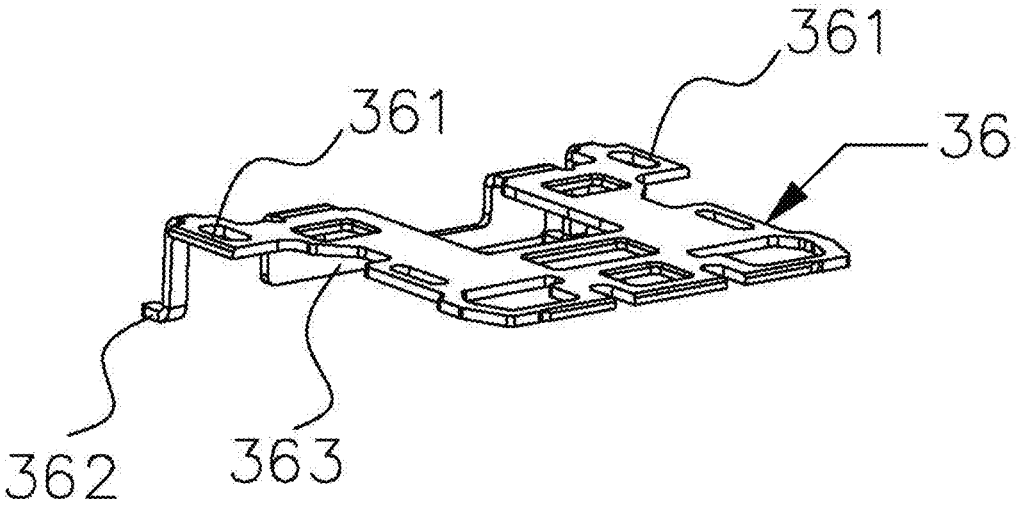
FIG. 10 is a schematic structural view of a shielding plate of the receptacle connector according to an embodiment of the present invention.
Figure 11:
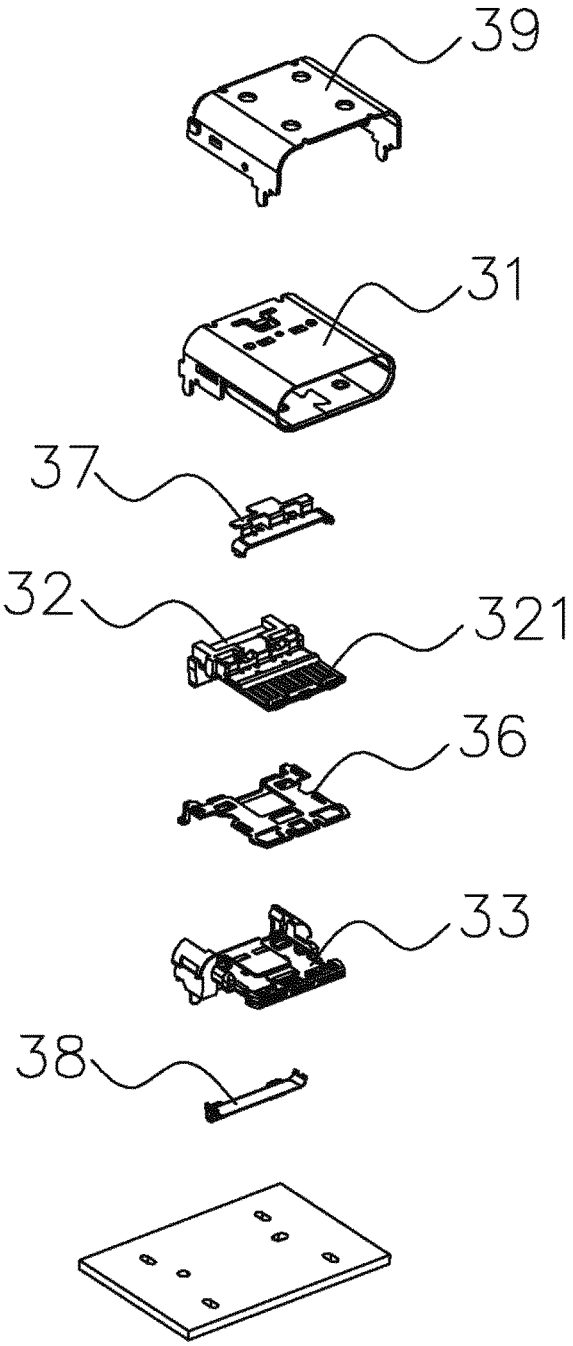
FIG. 11 is a structural explosive view of the receptacle connector according to an embodiment of the present invention.

With reference to FIG. 6, further, the inserting portion 21 further comprises an outer cap 215, wherein the outer cap 215 is secured to the first metal shell 213 and is adaptively coupled to the electrically conductive terminal seat 211.

The plug connector 2 may further comprise a cable (not illustrated in the drawings), wherein the cable is welded on the other portion of the printed circuit board 22. In the embodiments of the present invention, the cable is a flexible flat cable (FFC) or a circular cable.

In the embodiments of the present invention, a side wall of the lower housing is partially outwardly bent to form a receiving groove on the side wall of the lower housing, and when the printed circuit board is received in the receiving spaced formed between the upper housing and the lower housing, a lateral side of the printed circuit board is received in the receiving groove, such that the printed circuit board may be secured in the receiving space.

Hereinafter with reference to FIG. 8 to FIG. 12, the receptacle connector jointed with a plug connector component is described in detail. An embodiment of the present invention provides a receptacle connector 3, comprising a second metal shell 31 having a joint chamber 311, an upper cap covering the second metal shell 31 and limiting and securing the second metal shell 31, and a first module 32 and a second module 33 that are secured in the second metal shell 31.

A first terminal 321 is inlaid and insert molding in the first module 32; and a second terminal is inlaid and insert molding in the second module 33, a contact portion of the first terminal 321 overlapping a contact portion of the second terminal in a height direction perpendicular to an insertion direction, to form a base 34 and a tongue plate 35 extending to the joint chamber 311. The first terminal 321 is disposed on an upper end face of the tongue plate 35, and the second terminal is disposed on a lower end face of the tongue plate 35, such that power supply or data exchange may be implemented when being coupled with the corresponding connector.

Figure 12:
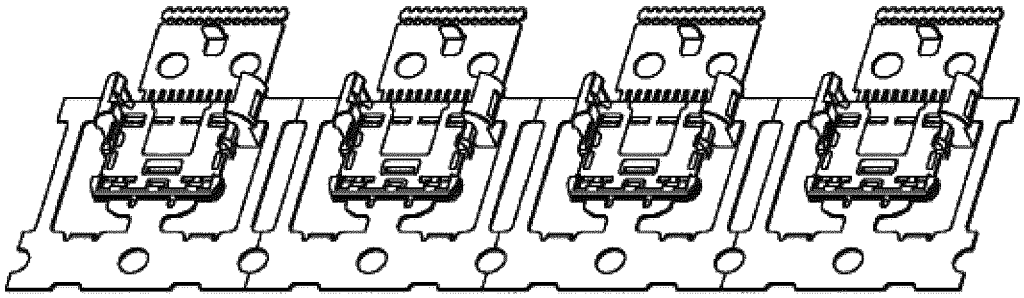
FIG. 12 is a schematic structural view illustrating one-cycle embedment and formation of a plurality of second modules in the manufacture process of the receptacle connector according to an embodiment of the present invention.

A shielding plate 36 is further inlaid and insert molding in the second module 33. The shielding plate 36 is disposed at a joint between the first module 32 and the second module 33, that is, at the second terminal. The shielding plate 36 and the plastic are embedded to form the second module 33. In addition, the material tape of the second terminal and the material tape of the shielding plate 36 are one-cycle embedded to form a plurality of second modules 33, as illustrated in FIG. 12.

A protrusion portion 361 exposing from a lateral end of the base 34 and abutting against the second metal shell 31 is provided on the shielding plate 36. Further, a contact portion 312 abutting against the protrusion portion 361 is formed via stamping towards the joint chamber 311 at a position on the second metal shell 31 corresponding to the protrusion portion 361. In this way, a contact path is added, thereby implementing multi-path grounding, and improving the performance of shielding the electromagnetic interference. A welding portion 362 extending downwards is provided on a rear end of the shielding plate 36.

The first module 32 and the second module 33 are assembled and secured in the second metal shell 31, and a positioning structure is provided between the first module 32 and the second module 33. In the embodiments of the present invention, the second module 33 at the base 34 is provided with a positioning groove 331 perpendicular to the joint direction, the first module 32 is provided with a positioning column 322 mating with the positioning groove, the second module 33 at the tongue plate 35 is provided with a positioning hole 332, and the first module 32 is provided with a positioning block 232 clipped into the positioning hole 332. The positioning groove 331 mates with the positioning column 322, the positioning hole 332 mates with the positioning block 323, such that the first module 32 and the second module 33 are property secured, thereby ensuring stability and reliability of the receptacle connector.

The first module 32 is further provided with a first grounding pad 37, and the second module 33 is further provided with a second grounding pad 38, wherein the first grounding pad 37 and the second grounding pad 38 are secured to two sides of the first module 32 and the second module 33 via laser welding.

An embodiment of the present invention further provides an electrical connector assembly, which joints a plug connector component with a receptacle connector. Coupling manners for jointing the plug connector component with the receptacle connector readily known to persons of ordinary skill in the art may all be applied in the embodiments of the present invention. Therefore, the embodiments of the present invention set no limitation thereto.

It should be noted that the specification and drawings of the present invention illustrate preferred embodiments of the present invention. However, the present invention may be implemented in different manners, and is not limited to the embodiments described in the specification. The embodiments described are not intended to limit the present invention, but are directed to rendering a thorough and comprehensive understanding of the disclosure of the present invention. In addition, the above described technical feature may incorporate and combine with each other to derive various embodiments not illustrated in the above specification, and such derived embodiments shall all be deemed as falling within the scope of the disclosure contained in the specification of the present invention. Further, a person skilled in the art may make improvements or variations according to the above description, and such improvements or variations shall all fall within the protection scope as defined by the claims of the present invention.

What is claimed is:

1. A plug connector, comprising:

an inserting portion;

a printed circuit board, one portion of which is coupled to the inserting portion;

an upper housing; and a lower housing, on which the upper housing is jointed, a receiving space for receiving the printed circuit board being formed between the upper housing and the lower housing, a side wall of the lower housing being partially outwardly bent to form a receiving groove on the side wall of the lower housing, a side of the printed circuit board being received in the receiving groove, the inserting portion being secured at a front end of the upper housing and the lower housing.

2. The plug connector according to claim 1, wherein:

a side wall of the upper housing is inwardly bent to form a holding portion, the holding portion abutting against the upper surface of the printed circuit board.

3. The plug connector according to claim 1, wherein:

a side wall of the upper housing is provided with an opening, the opening mating with a partially outwardly bending portion of the side wall of the lower housing, such that a lower end of the opening on the side wall of the upper housing abuts against an upper end of the bending portion.

4. The plug connector according to claim 1, wherein:

the electric connector comprises a cable;

wherein the cable is welded on the other portion of the printed circuit board, and the cable is a circular cable or flexible flat cable.

5. The plug connector according to claim 1, wherein:

the inserting portion comprises an electrically conductive terminal seat, an insulating shell, and a first metal shell;

wherein the insulating shell is provided with a terminal slot, the electrically conductive terminal seat is secured in the terminal slot, the terminal slot opens upwards, the first metal shell wraps an outer surface of the insulating shell, and the electrically conductive terminal seat is coupled to the printed circuit board.

6. The plug connector according to claim 5, wherein:

the electrically conductive terminal seat comprises an electrically conductive terminal and plastic; and the electrically conductive terminal seat is integrally formed by means of embedment of the electrically conductive terminal and the plastic.

7. The plug connector according to claim 6, wherein:

the inserting portion further comprises a shielding sheet;

wherein the shielding sheet is secured on the outer surface of the insulating shell, and is arranged between the insulating shell and the first metal shell.

8. The plug connector according to claim 7, wherein:

the inserting portion further comprises an outer cap;

wherein the outer cap is secured on the first metal shell, and is adaptively coupled to the electrically conductive terminal.

9. The plug connector according to claim 1, wherein:

a bump is provided at a rear end of the first metal shell; and an abutting portion abutting against a front end of the bump is provided at a front end of the upper housing and/or the lower housing.

10. The plug connector according to claim 9, wherein:

the abutting portion comprises a first abutting portion and a second abutting portion;

wherein the first abutting portion is provided at a front end of a top plate of the upper housing and/or the lower housing, and abuts against the front end of the bump; and the second abutting portion extends from two sides of the first abutting portion, and abuts against a lateral side of the bump.

11. The plug connector according to claim 9, wherein:

a clip pad is provided at the rear end of the bump; and a clip hole is provided on the upper housing and/or lower housing, the clip pad being clipped and secured to the clip hole.

12. The plug connector according to claim 9, wherein the clip pad and the clip hole are fusion spliced together via laser welding.

13. A receptacle connector, comprising a second metal shell having a joint chamber and a first module and a second module that are secured in the second metal shell, wherein: a first terminal is inlaid and insert molded in the first module; a second terminal is inlaid and insert molded in the second module, a contact portion of the first terminal overlapping a contact portion of the second terminal in a height direction perpendicular to an insertion direction; and a shielding plate is further inlaid and insert molded in the second module.

14. The receptacle connector according to claim 13, wherein a protrusion portion exposing from a lateral end of a base and abutting against the second metal shell is provided on the shielding plate.

15. The receptacle connector according to claim 14, wherein a contact portion abutting against the protrusion portion is formed via stamping towards the joint chamber at a position on the second metal shell corresponding to the protrusion portion.

16. The receptacle connector according to claim 13, wherein a welding portion extending downwards is provided on a rear end of the shielding plate.

17. The receptacle connector according to claim 13, wherein the first module and the second module are assembled and secured in the second metal shell, and a positioning structure is provided between the first module and the second module.

18. The receptacle connector according to claim 13, wherein the first module is further provided with a first grounding pad, and the second module is further provided with a second grounding pad, the first grounding pad and the second grounding pad being secured to two sides of the first module and the second module via laser welding.

19. The receptacle connector according to claim 13, wherein an upper cap for limiting and securing the second metal shell is provided on the second metal shell.

20. An electrical connector assembly, comprising a plug connector as defined in claim 1 and a receptacle connector as defined in claim 13.

* * * * *